US010827258B2

(12) United States Patent
Xiong et al.

(10) Patent No.: US 10,827,258 B2
(45) Date of Patent: Nov. 3, 2020

(54) ROBOT AND AUDIO DATA PROCESSING METHOD THEREOF

(71) Applicant: UBTECH ROBOTICS CORP LTD, Shenzhen (CN)

(72) Inventors: Youjun Xiong, Shenzhen (CN); Fanglin Xing, Shenzhen (CN)

(73) Assignee: UBTECH ROBOTICS CORP LTD, Shenzhen (CN)

( * ) Notice: Subject to any disclaimer, the term of this patent is extended or adjusted under 35 U.S.C. 154(b) by 0 days.

(21) Appl. No.: 16/447,978

(22) Filed: Jun. 21, 2019

(65) Prior Publication Data

US 2020/0213724 A1 Jul. 2, 2020

(30) Foreign Application Priority Data

Dec. 28, 2018 (CN) ..... 2018 1 1624983

(51) Int. Cl.
*H04R 1/40* (2006.01)
*G10L 19/008* (2013.01)
*H04R 1/02* (2006.01)

(52) U.S. Cl.
CPC ..... *H04R 1/406* (2013.01); *G10L 19/008* (2013.01)

(58) Field of Classification Search
CPC ..... G10L 19/008; H04R 1/406
See application file for complete search history.

(56) References Cited

U.S. PATENT DOCUMENTS

2019/0373386 A1* 12/2019 Tan ..... H04R 3/005
2020/0107118 A1* 4/2020 Salehin ..... H04S 7/30

FOREIGN PATENT DOCUMENTS

CN 108254721 * 7/2018
JP 2007221300 * 8/2007

OTHER PUBLICATIONS

Liu et al., "Method for recording audio in audio hardware", Feb. 2019; Derwent; Abstract of CN109378017.*

* cited by examiner

*Primary Examiner* — Regina N Holder

(57) ABSTRACT

The present disclosure provides a robot and an audio data processing method thereof. The robot includes a body, a main control module, and a sound pickup module. The sound pickup module includes microphones divided into a first microphone array and a second microphone array; the first microphone array includes N microphones disposed around the body; the second microphone array includes M microphones disposed on the body and located on a line connecting two of the microphones in the first microphone array; the main control module is configured to obtain N channels of audio data through the first microphone array, obtain M channels of audio data through the second microphone array, and perform a sound source localization and a sound pickup based on the N channels of audio data and the M channels of audio data.

8 Claims, 4 Drawing Sheets

ROBOT AND AUDIO DATA PROCESSING METHOD THEREOF

CROSS REFERENCE TO RELATED APPLICATIONS

This application claims priority to Chinese Patent Application No. CN201811624983.0, filed Dec. 28, 2018, which is hereby incorporated by reference herein as if set forth in its entirety.

BACKGROUND

1. Technical Field

The present disclosure relates to intelligent robot technology, and particularly to a robot and an audio data processing method thereof.

2. Description of Related Art

When designing a robot, if the position of a microphone array is not arranged correctly, the voice interaction will be affected. Because the most basic requirement and prerequisite for the beam-forming of the microphone array is that sounds should directly reach each microphone in the microphone array. Therefore, if an annular microphone array is disposed at the neck of the robot, the neck of the robot will hide the microphones behind the neck, which causes the sounds to be reflected by the neck and can not directly reach the microphone behind the neck of the robot, thus affecting the effect of sound pickup.

In order to resolve the above-mentioned problems, it is generally to place an annular microphone array on the head of the robot, or to use an annular microphone array and a linear microphone array at the same time, where the annular microphone array is disposed at the neck of the robot for realizing the 360-degree wake-up and 360-degree sound source localization of the robot, and the linear microphone array is disposed on the head of the robot for beam-forming so as to perform sound pickup.

However, disposing the annular microphone array on the head of the robot will cause a limit to the height of the robot. At the same time, since the annular microphone array needs to be kept horizontally and statically so as to achieve a better effect of sound pickup, which causes a limit to the movement of the head of the robot. In addition, the simultaneous use of the annular microphone array and the linear microphone array will cause that there is full of holes in the body of the robot, which affects the aesthetics of the robot and causes poor noise reduction.

BRIEF DESCRIPTION OF THE DRAWINGS

To describe the technical schemes in the embodiments of the present disclosure more clearly, the following briefly introduces the drawings required for describing the embodiments or the prior art. Apparently, the drawings in the following description merely show some examples of the present disclosure. For those skilled in the art, other drawings can be obtained according to the drawings without creative efforts.

DETAILED DESCRIPTION

In the following descriptions, for purposes of explanation instead of limitation, specific details such as particular system architecture and technique am set forth in order to provide a thorough understanding of embodiments of the present disclosure. However, it will be apparent to those skilled in the art that the present disclosure may be implemented in other embodiments that are less specific of these details. In other instances, detailed descriptions of well-known systems, devices, circuits, and methods are omitted so as not to obscure the description of the present disclosure with unnecessary detail.

It is to be understood that, the term "includes" and any of its variations in the specification and the claims of the present disclosure are intended to cover a non-exclusive inclusion. For example, a process, method, system, product or device including a series of steps or units is not limited to the steps or units listed, but optionally also includes steps or units not listed, or alternatively also includes other steps or units inherent to the process, method, product or device. Furthermore, the terms "first", "second", "third" and the like are used to distinguish different objects, and are not intended to describe a particular order.

In order to solve the problem that the height of the robot and the movement of the head of the robot are limited as well as poor noise reduction due to the improper disposition of the annular microphone array, the present disclosure provides a robot and an audio data processing method thereof. By disposing an annular and evenly distributed N microphones on a body of the robot and a microphone array composed of M microphones disputed on a line connecting two of the microphones in the N microphones to collect audio data, transmitting the collected N+M channels of audio data and reference audio data to a main control module of the robot, and using the main control module to realize a sound source localization and a sound pickup based on the audio data, which can support the 360-degree wake-up and sound source localization of the robot, and can support the beam-forming of directional beams. At the same time, by realizing the sound pickup through another microphone array, noises can be reduced effectively without causing limitation on the height of the robot, and the movement of the head of the robot will not be limited resolves the existing problems.

For the purpose of describing the technical solutions of the present disclosure, the following describes through specific embodiments.

Embodiment 1

Figure 1:
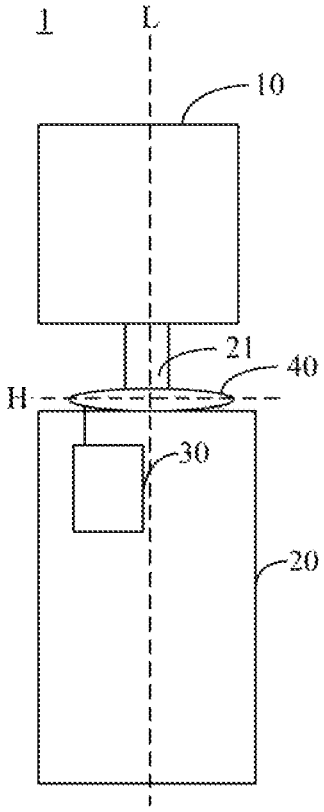
FIG. 1 is a schematic block diagram of a robot according to embodiment 1 of present disclosure.

FIG. 1 is a schematic block diagram of a robot according to embodiment 1 of present disclosure. As shown in FIG. 1, in this embodiment, a robot 1 is provided. The robot 1 includes a head 10, a body 20, a main control module 30, and a sound pickup module 40.

The sound pickup module 40 is electrically coupled to the main control module 30. The sound pickup module 40 includes a microphone array 41 which includes microphones. The microphone array 41 is divided into a first microphone array 41A (not shown) and a second microphone array 41B (not shown).

The body 20 includes a neck 21. The first microphone array 41A includes N microphones. In this embodiment, the N microphones are disposed evenly around the neck 21, where N≥3 and N is an integer. In other embodiments, the N microphones can be disposed around the neck 21 in a non-even manner.

Figure 2:
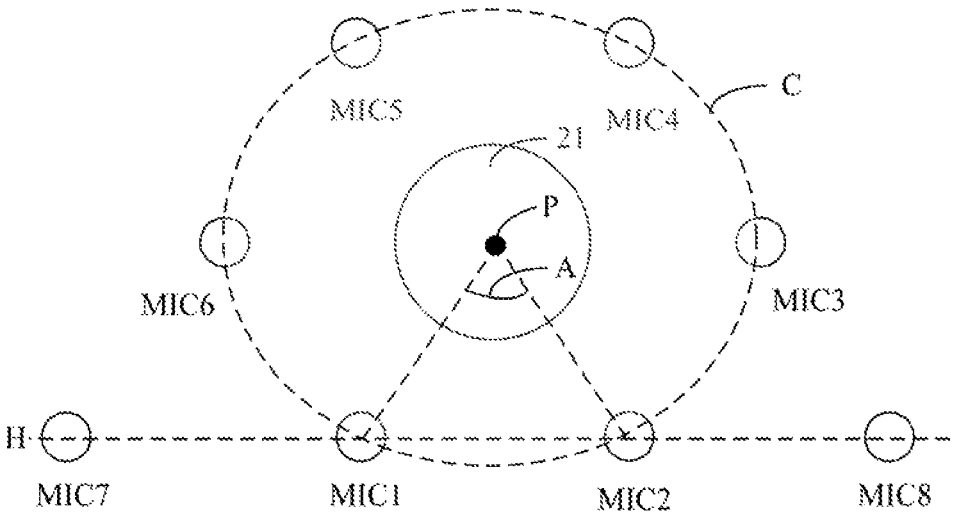
FIG. 2 is a schematic block diagram of a microphone array 41 of the robot of FIG. 1.

The second microphone array 41B includes M microphones. The M microphones are disposed on the body 20, which are located on a line connecting two of the microphones in the first microphone array 41A which are in front of the robot 1, where M≥1 and M is an integer. It should be noted that, for the robot 1, the front of the robot 1 refers to a direction corresponding to a face (on the head 10) of the robot 1. The form of the above-mentioned line can conform to the structural design of the robot 1. In this embodiment, the above-mentioned line is a straight line, and the M microphones are disposed on the neck 21 of the body 20. The first microphone array 41A includes six microphones, where the six microphones are disposed on the neck 21 of the robot 1. Specifically, the six microphones are disposed around the neck 21 of the robot 1. In which, the six microphones are distributed on a circumference centered on any point on a longitudinal axis of the body 20; where the circumference is perpendicular to the longitudinal axis. In other embodiments, the above-mentioned line can be a non-straight line such as a curve, and the M microphones can be disposed on another part of the body 20. In addition, the first microphone array 41A may include another amount of microphones which is equal to or larger than three. Furthermore, the circumference can be not perpendicular to the longitudinal axis, which can have an included angle such as an angle of 15 degrees or 30 degrees with respect to the longitudinal axis, where the included angle can be adjusted according to the algorithms to be used. FIG. 2 is a schematic block diagram of a microphone array 41 of the robot of FIG. 1. As shown in FIG. 2, in one embodiment, the first microphone array 41A includes a first microphone MIC1, a second microphone MIC2, a third microphone MIC3, a fourth microphone MIC4, a fifth microphone MIC5, and a sixth microphone MIC6, where the first microphone MIC1 and the second microphone MIC2 are located on a horizontal line H perpendicular to a longitudinal axis L (see FIG. 1) of the body 20, and each adjacent two of the first microphone MIC1, the second microphone MIC2, the third microphone MIC3, the fourth microphone MIC4, the fifth microphone MIC5, and the sixth microphone MIC6 have the same spacing and form an included angle A of 60 degrees with respect to a center P of a circumference C which is centered on any point on the longitudinal axis L of the body 20, that is, the microphones are evenly distributed around the neck 21 of the robot 1 at 360 degrees. The first microphone MIC1, the second microphone MIC2, the third microphone MIC3, the fourth microphone MIC4, the fifth microphone MIC5, and the sixth microphone MIC6 constitute the first microphone array 41A which is the annular microphone array 41A with six microphones which surround the neck 21 of the robot 1. The second microphone array 41B includes two microphones, where the two microphones are disposed on the neck 21 of the robot 1 and are located on the line connecting two of the six microphones of the first microphone array 41A which are in front of the robot 1, that is, the first microphone MIC1 and the second microphone MIC2. In other embodiments, the horizontal line H can be not perpendicular to the longitudinal axis L, which can have an included angle such as an angle of 15 degrees or 30 degrees with respect to the longitudinal axis L, where the included angle can be adjusted according to the algorithms to be used.

The main control module 30 is configured to obtain N channels of audio data through the first microphone array 41A, obtain M channels of audio data through the second microphone array 41B, and perform a sound source localization and a sound pickup based on the N channels of audio data and the M channels of audio data.

In one embodiment, the robot 1 may be a humanoid robot or a human-like robot, which is not limited herein.

In one embodiment, the sound pickup module 40 further includes a MIC small board 42.

The MIC small board 42 is electrically coupled to each of the microphone array 41 and the main control module 30.

The MIC small board 42 is configured to perform an analog-to-digital conversion on the M channels of audio data and the N channels of audio data, encode the converted audio data, and transmit the encoded audio data to the main control module 30.

In one embodiment, the MIC small board 42 can convert the analog audio data collected by each microphone into corresponding digital audio data, then number the digital audio data, and then transmit the numbered digital audio data to the main control module 30.

In one embodiment, the MIC small board 42 includes an analog-to-digital converter 42A electrically coupled to each of the microphone array 41 and the main control module 30.

Figure 3:
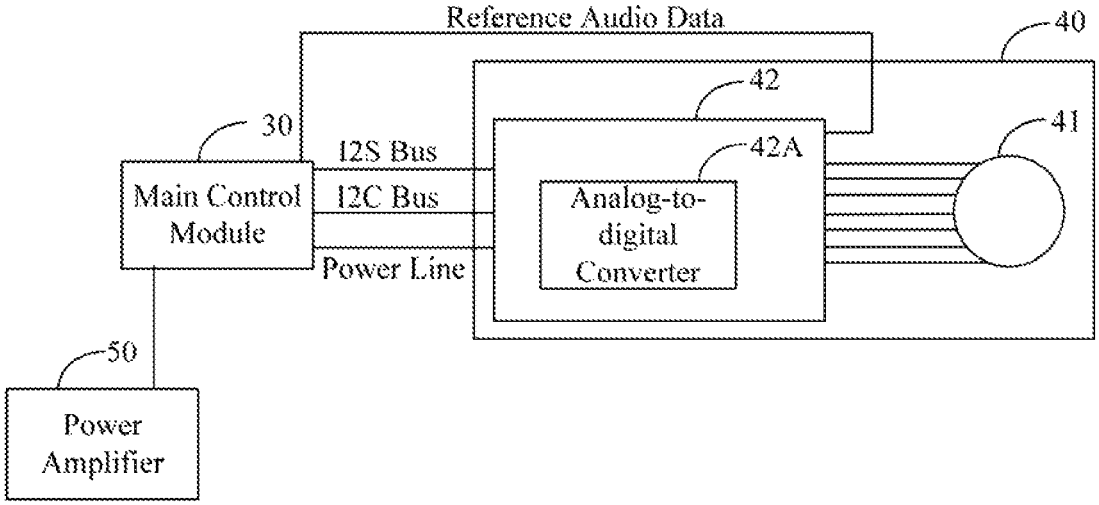
FIG. 3 is a schematic block diagram of a sound pickup module 40 of the robot of FIG. 1.

FIG. 3 is a schematic block diagram of a sound pickup module 40 of the robot of FIG. 1. As shown in FIG. 3, in one embodiment, the sound pickup module 40 includes the MIC small board 42 which is electrically coupled to the microphone array 41 through a microphone wire, where the MIC small board 42 includes the analog-to-digital converter 42A. The MIC small board 42 is electrically coupled to the main control module 30 through an I2S bus, an I2C bus and a power line. The MIC small board 42 is configured to perform an analog-to-digital conversion on the N channels of audio data and the M channels of audio data which are collected by the microphone array 41 through the analog-to-digital converter 42A, fuses the converted N channels of audio data and the converted M channels of audio data, and transmits the fused audio data to the main control module 30 through an I2S interface. The MIC small board 42 also numbers the N channels of audio data and the M channels of audio data, respectively, so that the audio data is associated with the microphone which collected the audio data by numbering.

As shown in FIG. 2, in one embodiment, the second microphone array 411) includes a seventh microphone MIC7 and an eighth microphone MIC8. The seventh microphone MIC7 and the eighth microphone MIC8 are distributed on the line (e.g., the horizontal line H) connecting the first microphone MIC1 and the second microphone MIC2, and the first microphone MIC1, the second microphone MIC2, the seventh microphone MIC7, and the eighth microphone MIC8 are distributed on the neck 21 of the robot 1 with the same spacing. The first microphone MIC1, the second microphone MIC2, the seventh microphone MIC7, and the eighth microphone MIC8 constitute the linear second microphone array 41B with four microphones. The first microphone MIC1, the second microphone MIC2, the seventh microphone MIC7, and the eighth microphone MIC8 are located on the same horizontal line H perpendicular to the body 20, and are disposed at the neck of the robot 1. The sounds within 180 degrees in front of the robot 1 are picked up by the linear second microphone array 41B with four microphones. In other embodiments, the horizontal line II can be not perpendicular to the body 20, which can have an included angle such as an angle of 15 degrees or 30 degrees with respect to the body 20, where the included angle can be adjusted according to the algorithms to be used.

In one embodiment, the robot 1 further includes a power amplifier 50 electrically coupled to the main control module 30. The main control module 30 is configured to generate X channels of reference audio data based on audio data obtained from the power amplifier 50 to transmit to the MIC small board 42. The MIC small board 42 is further configured to perform an analog-to-digital conversion on the X channels of reference audio data, encode the X channels of converted reference audio data, and transmit the encoded X channels of reference audio data to the main control module 30. The X channels of reference audio data is transmitted to the MIC small board 42 through the main control module 30, and the input X channels of reference audio data is numbered and fused with the N channels of audio data and the M channels of audio data by the MIC small board 42 to transmit to the main control module 30 through the I2S interface. The main control module 30 eliminates echoes based on the reference audio data, filters out the influence of the environmental noise, and further improves the accuracy of the sound source localization and the voice recognition.

The main control module 30 is further configured to obtain the audio data played by the power amplifier 50 and generate the X channels of reference audio data based on the audio data played by the power amplifier 50.

In one embodiment, if the played audio data obtained by the main control module 30 has dual channels, two channels of reference audio data are generated; if the played audio data obtained by the main control module 30 has mono channel, one channel of reference audio data is generated; and if the played audio data obtained by the main control module 30 has four channels, four channels of reference audio data are generated. Taking the dual channels reference audio data as an example, the main control module 30 will be electrically coupled to the MIC small board 42 directly through data line(s), and then transmits the two channels of reference audio data played by the power amplifier 50 of the main control module 30 to the MIC small board 42. In which, the amount of the data line(s) corresponds to the amount of the channels of the reference audio data, such that each channel uses one data line.

In one embodiment, the main control module 30 includes a data buffer pool 51 configured to store the M channels of audio data, the N channels of audio data, and the X channels of reference audio data.

In one embodiment, the main control module 30 stores the N channels of audio data, the M channels of audio data, and the reference audio data which are obtained from the I2S interface of the MIC small board 42 in the data buffer pool 51. The main control module 30 performs data multiplexing on the audio data in the data buffer pool 51, and realizes a 360-degree wake-up and a beam-forming by executing a predetermined algorithm so as to perform sound pickup. It should be noted that, the above-mentioned predetermined algorithm may include an existing localization algorithm for performing sound source localization based on the collected audio data, an existing wake-up algorithm for waking up the robot based on the collected audio data, and an existing beam-forming and sound pickup algorithm for performing the beam-forming and the sound pickup based on the collected audio data.

In one embodiment, the robot wake-up and the echo cancellation are performed by using die corresponding audio data collected by the annular microphone array with six microphones and the two channels of reference audio data (a total of eight channels of audio data), that is, the sound source localization is performed based on the above-mentioned eight channels of audio data, and an angle difference between a sound source position and a current position is determined through the sound source localization. The robot 1 is controlled to turn according to the angle difference and then waked up. After waking up the robot 1, the echo cancellation, the beam-forming, the sound pickup and the voice recognition are performed on the audio data collected by the linear microphone array with four microphones and the two channels of reference audio data (a total of six channels of audio data), that is, audio data for voice recognition is obtained after performing the echo cancellation, the noise reduction and the beam-forming on the above-mentioned six channels of audio data. After recognizing the audio data by an audio recognizing unit, the audio data is converted to texts.

In one embodiment, the main control module 30 may be an Android development board, and a data buffer pool is configured in the software layer of the Android development board. The N channels of audio data, the M channels of audio data and the two channels of reference audio data which are transmitted by the sound pickup module arc numbered and stored in the above-mentioned data buffer pool, and the required audio data is obtained from the data buffer pool in parallel by performing the wake-up algorithm and a recognition algorithm in parallel. It should be noted that, the above-mentioned wake-up algorithm may be various existing voice wake-up algorithms, and the above-mentioned recognition algorithm may be various existing voice recognition algorithms. By multiplexing the audio data collected by the microphones, the audio data obtained by a part of the microphones is used by both the wake-up algorithm and the recognition algorithm. In such a manner, the microphone array positioned at the neck 21 of the robot 1 can still achieve the 360-degree sound source localization and the 360-degree wake-up, while ensuring the collection (i.e., the beam-forming and the sound pickup) of audio data for voice recognition, which does not affect voice recognition and has better noise reduction effect.

In this embodiment, a robot is provided. By disposing the annular and evenly distributed N microphones on the neck of the robot and the microphone array composed of M microphones disputed on the line connecting two of the microphones in the N microphones to collect the audio data, transmitting the collected N channels of audio data and M channels of audio data to the main control module of the robot, and using the main control module to realize the sound source localization and the sound pickup based on the audio data, which can support the 360-degree wake-up and the sound source localization of the robot, and can support the beam-forming of directional beams. At the same time, by realizing the sound pickup through another microphone array, noises can be reduced effectively without causing limitation on the height of the robot, and the movement of the head of the robot will not be limited, which resolves the existing problems that the height of the robot and the movement of the head of the robot are limited as well as poor noise reduction due to the improper disposition of the annular microphone array.

Embodiment 2

Figure 4:
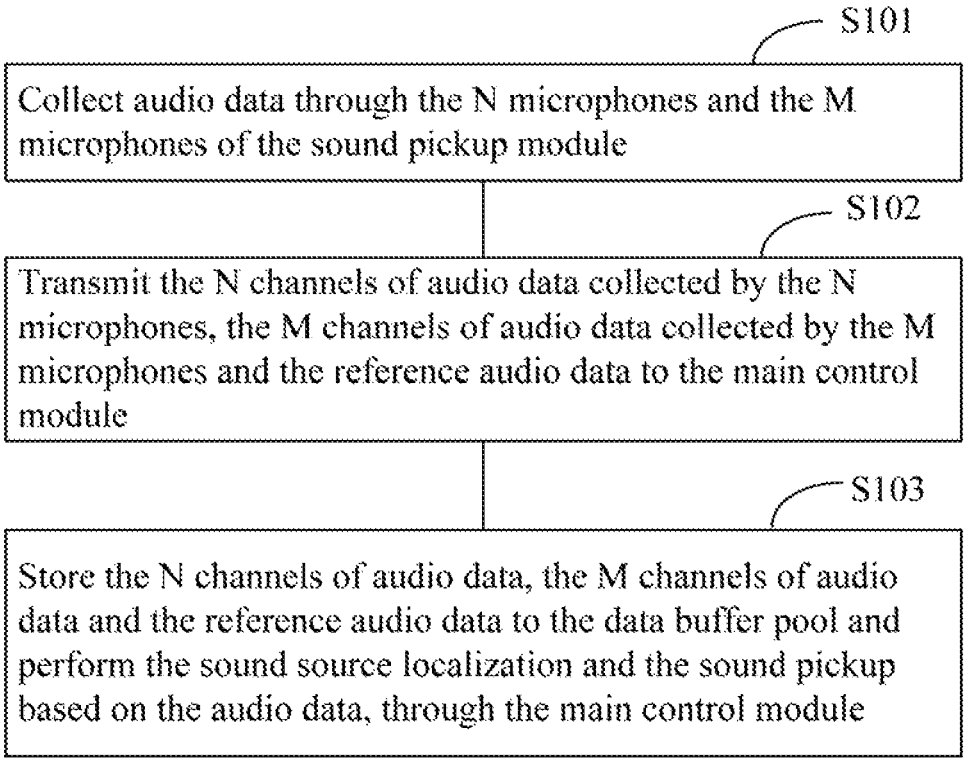
FIG. 4 is a flow chart of an audio data processing method based on the robot of FIG. 1 according to embodiment 2 of present disclosure.

FIG. 4 is a flow chart of an audio data processing method based on the robot of FIG. 1 according to embodiment 2 of present disclosure. In this embodiment, an audio data processing method is provided. The method is a computer-implemented method executable for a processor, which may be implemented through the robot as shown in FIG. 1 or through a storage medium. As shown in FIG. 4, the method includes the following steps.

S101: collecting audio data through the N microphones and the M microphones of the sound pickup module.

In one embodiment, the audio data is collected through the N microphones and the M microphones disposed at the neck 21 of the robot 1. The N microphones arc distributed on the circumference C centered on any point P on the longitudinal axis L of the body 20, where the circumference C is perpendicular to the longitudinal axis L. N≥3 and N is an integer. In other embodiments, the circumference C can be not perpendicular to the longitudinal axis L, which can have an included angle such as an angle of 15 degrees or 30 degrees with respect to the longitudinal axis L, where the included angle can be adjusted according to the algorithms to be used.

In one embodiment, the M microphones are distributed on the line connecting two of the microphones in the above-mentioned N microphones which are in front of the robot 1, where M≥1 and M is an integer.

In one embodiment, the N microphones are six microphones, where the six microphones are disposed on the neck 21 of the robot 1. In which, the six microphones are distributed on THE circumference C centered on any point P on the longitudinal axis L of the body 20 of the robot 1, where the circumference C is perpendicular to the longitudinal axis L, and the six microphones form an annular microphones array with six microphones. The M microphones are two microphones, where the two microphones are disposed on the neck 21 of the robot 1 and are located on the line connecting two of the six microphones, and the two microphones and two of the six microphones on the line form the linear microphone array with four microphones. In addition, the four microphones are disposed on the same horizontal line H of the neck 21 of the robot 1 with the same spacing.

S102: transmitting the N channels of audio data collected by the N microphones, the M channels of audio data collected by the M microphones and the reference audio data to the main control module.

In one embodiment, the N channels of audio data collected by the N microphones, the M channels of audio data collected by the M microphones and the reference audio data are transmitted to the main control module 30, so as to realize the sound source localization and the sound pickup based on the above-mentioned audio data through the main control module 30.

In one embodiment, through the MIC small board 42 electrically coupled to the N microphones and the M microphones, after performing the analog-to-digital conversion on the N channels of audio data and the M channels of audio data, the data fusion is performed on the analog-to-digital converted audio data, and then the fused audio data is transmitted to the main control module 30.

In one embodiment, when the MIC small board 42 performs the data fusion, the reference audio data is received to fuse with the N channels of audio data and the M channels of audio data, and the fused audio data is transmitted to the main control module 30.

In one embodiment, the MIC small board 42 also numbers each channel of the audio data, which numbers the N channels of audio data, the M channels of audio data and the reference audio data, respectively.

It should be noted that, the above-mentioned reference audio data is generated based on the audio data played by the power amplifier 50 through the main control module 30 obtaining the audio data played by the power amplifier 50. If the played audio data obtained by the main control module 30 has dual channels, two channels of reference audio data are generated; if the played audio data obtained by the main control module 30 has mono channel, one channel of reference audio data is generated; and if the played audio data obtained by the main control module 30 has four channels, four channels of reference audio data are generated. Taking the dual channels' reference audio data as an example, the main control module 30 will be electrically coupled to the MIC small board 42 directly through two data lines, and then transmits the two channels of reference audio data played by the power amplifier 50 of the main control module 30 to the MIC small board 42.

S103: storing the N channels of audio data, the M channels of audio data and the reference audio data to the data buffer pool and performing the sound source localization and the sound pickup based on the audio data, through the main control module.

In one embodiment, the main control module 30 executes a corresponding algorithm based on the audio data stored in the data buffer pool 51 to perform the sound source localization and he sound pickup so as to realize the wake-up and the voice recognition. Specifically, the main control module 30 obtains the audio data of the corresponding number from the data buffer pool 51 according to the algorithm to be executed, and executes the corresponding algorithm.

In one embodiment, the main control module 30 obtains the N channels of audio data, the M channels of audio data and the two channels of reference audio data from the data buffer pool 51, and executes the wake-up algorithm based on the N channels of audio data, the M channels of audio data and the two channels of reference audio data to realizes the 360-degree wake-up of the robot 1. The main control module 30 obtains the M channels of audio data, the N channels of audio data, and the two channels of reference audio data from the data buffer pool 51 in parallel, and executes a voice recognition algorithm based on the N channels of audio data, the M channels of audio data, and the two channels of reference audio data to realize voice recognition on the words spoken by the user.

In one embodiment, the above-mentioned step S103 may include the following steps.

S1031: storing the reference audio data, the N channels of audio data and the M channels of audio data to the data buffer pool.

S1032: obtaining a first group of the audio data from the data buffer pool to use a first predetermined algorithm to perform the echo cancellation, the sound source localization and the wake-up.

S1033: obtaining a second group of the audio data from the data buffer pool to use a second predetermined algorithm to perform the echo cancellation, the beam-forming and the audio noise reduction.

In one embodiment, the above-mentioned N channels of audio data is six channels of audio data, the M channels of audio data is two channels of audio data, and the above-mentioned reference audio data includes two channels of reference audio data.

In one embodiment, the audio data collected by each microphone is numbered correspondingly, that is, the audio data obtained by a first microphone in the microphones arrays is taken as first audio data, the audio data obtained by a second microphone in the microphones arrays is taken as second audio data, the audio data obtained by a third microphone in the microphones arrays is taken as third audio data, the audio data obtained by a fourth microphone in the microphones arrays is taken as fourth audio data, the audio data obtained by a fifth microphone in the microphones arrays is taken as fifth audio data, the audio data obtained by a sixth microphone in the microphones arrays is taken as sixth audio data, the audio data obtained by a seventh microphone in the microphones arrays is taken as seventh audio data, the audio data obtained by an eighth microphone in the microphones arrays is taken as eighth audio data, a first channel reference audio data in the two channels of reference audio data is taken as a ninth audio data, and a second channel reference audio data in the two channels of reference audio data is taken as a tenth audio data. The above-mentioned first group of reference audio data is taken as a tenth audio data. The above-mentioned first group of the audio data comprises the first audio data, the second audio data, the third audio data, the fourth audio data, the fifth audio data, the sixth audio data, the ninth audio data, and the tenth audio data; and the above-mentioned second group of the audio data comprises the first audio data, the second audio data, the seventh audio data, the eighth audio data, the ninth audio data, and the tenth audio data.

In one embodiment, the robot wake-up is performed by using the corresponding audio data collected by the annular microphone array with six microphones and the two channels of reference audio data (a total of eight channels of audio data), that is, a 360-degree sound source localization, a 360-degree robot wake-up, and an echo cancellation are performed based on the first audio data, the second audio data, the third audio data, and the fourth audio data, the fifth audio data, the sixth audio data, the ninth audio data, and the tenth audio data, and an angle difference between a sound source position and a current position is determined through the sound source localization. The robot is controlled to turn according to the angle difference and then waked up. After waking up the robot, the 360-degree sound source localization, the 360-degree robot wake-up, and the echo cancellation are performed on the audio data collected by the linear microphone array with four microphones and the two channels of reference audio data (a total of six channels of audio data), that is, audio data for voice recognition is obtained after performing the echo cancellation, the noise reduction and the beam-forming on the first audio data, the second audio data, the seventh audio data, the eighth audio data, the ninth audio data, and the tenth audio data. After recognizing the audio data by an audio recognizing unit, the audio data is converted to texts, so as to realize the voice recognition.

It should be noted that, the above-mentioned first predetermined algorithm may be an existing wake-up algorithm capable of realizing the sound source localization and the robot wake-up and the second predetermined algorithm may be an existing algorithm capable of realizing the voice recognition.

In this embodiment, an audio data processing method based on the robot of embodiment 1 is provided. Similarly, by disposing the annular and evenly distributed N microphones on the neck of the robot and the microphone array composed of M microphones disputed on the line connecting two of the microphones in the N microphones to collect the audio data, transmitting the collected N channels of audio data, the M channels of audio data and the reference audio data to the main control module of the robot, and using the main control module to realize the sound source localization and the sound pickup based on the audio data, which can support the 360-degree wake-up and the sound source localization of the robot, and can support the beam-forming of directional beams. At the same time, by realizing the sound pickup through another microphone array, noises can be reduced effectively without causing limitation on the height of the robot, and the movement of the head of the robot will not be limited, which resolves the existing problems that the height of the robot and the movement of the head of the robot are limited as well as poor noise reduction due to the improper disposition of the annular microphone array.

The above-mentioned embodiments are merely intended for describing but not for limiting the technical schemes of the present disclosure. Although the present disclosure is described in detail with reference to the above-mentioned embodiments, it should be understood by those skilled in the art that, the technical schemes in each of the above-mentioned embodiments may still be modified, or some of the technical features may be equivalently replaced, while these modifications or replacements do not make the essence of the corresponding technical schemes depart from the spirit and scope of the technical schemes of each of the embodiments of the present disclosure, and should be included within the scope of the present disclosure.

What is claimed is:

1. A robot, comprising:

a body;

a main control module; and a sound pickup module electrically coupled to the main control module, wherein the sound pickup module comprises microphones divided into a first microphone array and a second microphone array;

wherein, the first microphone array comprises N microphones disposed around the body, where N≥3 and N is an integer;

wherein, the second microphone array comprises M microphones disposed on the body and located on a line connecting two of the microphones in the first microphone array, where M≥1 and M is an integer;

wherein, the main control module is configured to obtain N channels of audio data through the first microphone array, obtain M channels of audio data through the second microphone array, and perform a sound source localization and a sound pickup based on the N channels of audio data and the M channels of audio data;

wherein the main control module comprises a data buffer pool configured to store X channels of reference audio data, the M channels of audio data and the N channels of audio data; and wherein the main control module is further configured to store the X channels of reference audio data, the N channels of audio data and the M channels of audio data to the data buffer pool, obtain a first group of the audio data from the data buffer pool to use a first predetermined algorithm to perform an echo cancellation, the sound source localization and a wake-up, and obtain a second group of the audio data from the data buffer pool to use a second predetermined algorithm to perform an echo cancellation, a beam-forming and an audio noise reduction.

2. The robot of claim 1, wherein the sound pickup module further comprises:

a MIC small board electrically coupled to each of the microphone array and the main control module, wherein the MIC small board is configured to perform an analog-to-digital conversion on the M channels of audio data and the N channels of audio data, encode the converted audio data, and transmit the encoded audio data to the main control module.

3. The robot of claim 2, wherein the MIC small board comprises:

an analog-to-digital converter electrically coupled to each of the microphone arrays and the main control module.

4. The robot of claim 2, further comprising:

a power amplifier electrically coupled to the main control module;

wherein the main control module is configured to generate the X channels of reference audio data based on audio data obtained from the power amplifier to transmit to the MIC small board, and the MIC small board is further configured to perform an analog-to-digital conversion on the X channels of reference audio data, encode the converted X channels of reference audio data, and transmit the encoded X channels of reference audio data to the main control module.

5. The robot of claim 4, wherein, the main control module is further configured to obtain the audio data played by the power amplifier and generate the X channels of reference audio data based on the audio data played by the power amplifier.

6. The robot of claim 1, wherein the body comprises:

a neck;

wherein, the first microphone array comprises six microphones, the six microphones are disposed around the neck and are distributed on a circumference centered on any point on a longitudinal axis of the body; wherein the circumference is perpendicular to the longitudinal axis.

7. A computer-implemented audio data processing method based on the robot of claim 1, comprising executing on a processor of the robot the steps of:

collecting audio data through the N microphones and the M microphones of the sound pickup module;

transmitting the N channels of audio data collected by the N microphones, the M channels of audio data collected by the M microphones and the reference audio data to the main control module;

storing, by the main control module, the N channels of audio data, the M channels of audio data and the reference audio data to a data buffer pool; and performing, by the main control module, the sound source localization and the sound pickup based on the audio data;

wherein the step of storing, by the main control module, the N channels of audio data, the M channels of audio data and the reference audio data to the data buffer pool and the step of performing, by the main control module, the sound source localization and the sound pickup based on the audio data further comprise:

storing the reference audio data, the N channels of audio data and the M channels of audio data to the data buffer pool;

obtaining a first group of the audio data from the data buffer pool to use a first predetermined algorithm to perform an echo cancellation, the sound source localization and a wake-up; and obtaining a second group of the audio data from the data buffer pool to use a second predetermined algorithm to perform an echo cancellation, a beam-forming and an audio noise reduction.

8. The method of claim 7, wherein the N channels of audio data is six channels of audio data, the M channels of audio data is two channels of audio data, and the reference audio data comprises two channels of reference audio data;

wherein, the audio data obtained by a first microphone in the microphones arrays is taken as first audio data, the audio data obtained by a second microphone in the microphones arrays is taken as second audio data, the audio data obtained by a third microphone in the microphones arrays is taken as third audio data, the audio data obtained by a fourth microphone in the microphones arrays is taken as fourth audio data, the audio data obtained by a fifth microphone in the microphones arrays is taken as fifth audio data, the audio data obtained by a sixth microphone in the microphones arrays is taken as sixth audio data, the audio data obtained by a seventh microphone in the microphones arrays is taken as seventh audio data, the audio data obtained by an eighth microphone in the microphones arrays is taken as eighth audio data, a first channel reference audio data in the two channels of reference audio data is taken as a ninth audio data, and a second channel reference audio data in the two channels of reference audio data is taken as a tenth audio data;

wherein, the first group of the audio data comprises the first audio data, the second audio data, the third audio data, the fourth audio data, the fifth audio data, the sixth audio data, the ninth audio data, and the tenth audio data; and wherein, the second group of the audio data comprises the first audio data, the second audio data, the seventh audio data, the eighth audio data, the ninth audio data, and the tenth audio data.

* * * * *